US005369355A

United States Patent [19]

Roe

[11] Patent Number: 5,369,355

[45] Date of Patent: Nov. 29, 1994

[54] COMPENSATION CIRCUIT FOR TRANSFORMER LINEARIZATION

[75] Inventor: John Roe, Orange, Calif.

[73] Assignee: B/E Aerospace, Irvine, Calif.

[21] Appl. No.: 975,187

[22] Filed: Nov. 12, 1992

[51] Int. Cl.[5] ..... G05F 7/00

[52] U.S. Cl. ..... 323/356; 323/357

[58] Field of Search ..... 323/356, 357; 324/127; G05F 7/00

[56] References Cited

U.S. PATENT DOCUMENTS

| | | | |
|---|---|---|---|
| 3,649,760 | 3/1972 | Glidden | 179/1 A |
| 3,714,548 | 1/1973 | Macrander | 323/48 |
| 3,786,338 | 1/1974 | Gilbert | 336/195 |
| 4,054,829 | 10/1977 | Searle | 330/110 |
| 4,107,620 | 8/1978 | Birman et al. | 330/265 |
| 4,118,600 | 10/1978 | Stahl | 179/1 D |
| 4,146,845 | 3/1979 | Lunquist | 330/255 |
| 4,229,618 | 10/1980 | Gamble | 179/1 F |
| 4,346,266 | 8/1982 | Brockmann et al. . | |
| 4,361,732 | 11/1982 | Wood | 179/18 AH |
| 4,393,353 | 7/1983 | Minagawa | 330/102 |
| 4,503,289 | 3/1985 | Spires | 323/356 |
| 4,629,974 | 12/1986 | Friedl | 323/357 |
| 4,652,810 | 3/1987 | Hayashi | 323/357 |
| 4,659,981 | 4/1987 | Lumsden | 323/356 |
| 5,150,270 | 9/1992 | Ernst | 323/357 |
| 5,274,704 | 12/1993 | Jakab | 379/403 |
| 5,276,394 | 1/1994 | Mayfield | 323/356 |

*Primary Examiner*—Jeffrey L. Sterrett
*Attorney, Agent, or Firm*—Kenyon & Kenyon

[57] ABSTRACT

Method and apparatus for linearizing the performance of electrical transformers using negative feedback. Two circuits are disclosed which use an operational amplifier to compensate a three-winding transformer, yielding an improved low-end frequency response, reduced harmonic distortion, and substantially resistive input and output impedances.

10 Claims, 2 Drawing Sheets

COMPENSATION CIRCUIT FOR TRANSFORMER LINEARIZATION

FIELD OF THE INVENTION

The invention relates to devices and methods for linearizing the performance of electrical transformers. More specifically, it relates to circuits for compensating a transformer's operation with active electronic devices to reduce the transformer's tendency to saturate.

BACKGROUND OF THE INVENTION

The use of transformers in electrical systems is well known in the art. Transformers are commonly used to provide galvanic isolation for wires carrying signals over substantial lengths. The operating range over which a conventional transformer is capable of providing linear, distortionless, and unattenuated signal transfer, however, is limited by the magnetic saturation of the transformer's core. Saturation occurs when a transformer is driven to induce a net flux density higher than its core can support. It is known from transformer theory that flux density is proportional to the ratio of winding voltage to frequency. Thus a transformer will tend to saturate at higher voltages and lower frequencies.

In audio applications, for instance, the limitations attributable to core saturation are particularly apparent in the performance of commercially available miniature transformers at lower signal frequencies. One known alternative for improved low-end frequency performance is to use a larger transformer. In applications where space is at a premium, such an alternative is often not a viable one. Moreover, larger transformers are heavier and costlier.

Another alternative is to avoid transformer coupling altogether. Transformerless systems, however, lack the advantages of galvanic isolation and are thus more susceptible to damage from connection faults, for instance, as where signal wires are accidentally shorted to nearby sources of DC current. Transformerless systems are also more susceptible to electro-static discharge (ESD) and interference from other signal sources, and provide less common mode rejection.

The present invention provides a transformer compensating circuit which improves the linearity of transformer operation. The low-end frequency response is markedly improved while harmonic distortion is reduced. Moreover, input and output impedances are also linearized.

SUMMARY OF THE INVENTION

The present invention provides a circuit for linearizing the performance of a transformer. The present invention achieves improved performance by compensating the operation of the transformer to minimize any tendency to saturate.

Generally, the present invention comprises a circuit arrangement which uses negative feedback created by an active high-gain device, such as an operational amplifier (op-amp), to avoid saturation of a transformer. In a first circuit arrangement according to the present invention, referred to as the input circuit, transformer coupling is produced with nearly zero voltage across each transformer winding. In a second circuit arrangement according to the present invention, referred to as the output circuit, transformer coupling is produced with nearly zero current through one of the windings.

In an exemplary embodiment of the input circuit, a signal voltage source is coupled, through resistors, across one winding of a three-winding transformer. A second winding is coupled across the inputs of an op-amp. The third winding, in series with a resistor, is coupled between the op-amp output and the inverting input of the op-amp. By virtue of negative feedback, the op-amp forces a virtual short-circuit across its two inputs and thus across the second winding. As a result, the voltages across all three windings of the transformer are virtually zero volts. Since core saturation is caused by excessive flux density, which is proportional to winding voltage, minimizing the winding voltage minimizes the tendency of the transformer to saturate and thus keeps the operation of the transformer within its linear region. Moreover, since voltage is minimized, the frequency at which the flux density will reach the saturation level will also be minimized.

In an exemplary embodiment of the output circuit, a signal source is applied to the noninverting input of an op-amp. The op-amp output drives a first winding of a three-winding transformer. A second winding is coupled to the inverting input of the op-amp. A load is applied across the third winding. A voltage is induced across the second winding which mirrors the voltage applied by the op-amp across the first winding. In this way, feedback is provided from the output to the inverting input of the op-amp. As a result, the inverting input follows the signal applied to the noninverting input with virtually no current flow through the second winding. This yields a waveform across the second winding that faithfully follows the input and that is not corrupted by any voltage drops that would normally be caused by current flowing through the resistive and inductive elements of the second winding. By virtue of negative feedback, the op-amp will drive the first winding to match the voltage across the second winding. By symmetry, this faithful representation of the input signal voltage is also induced in the output winding which drives the load.

DETAILED DESCRIPTION

Figure 1:
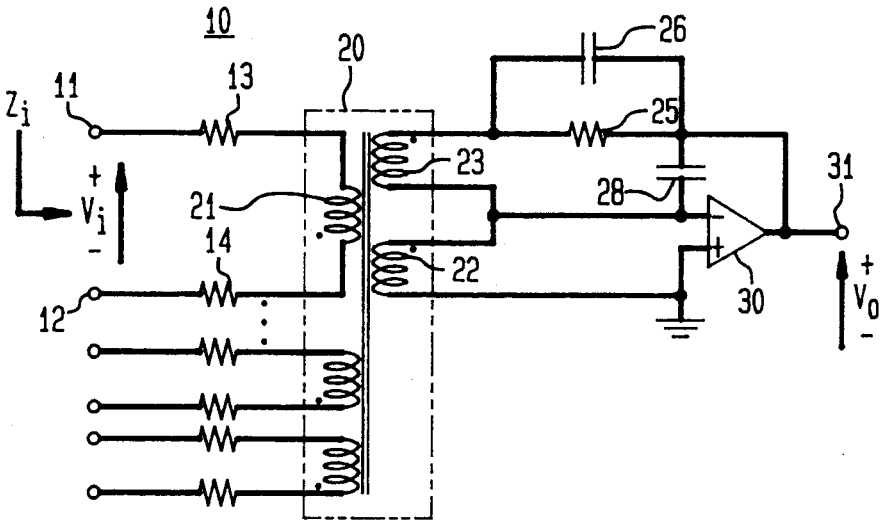
FIGS. 1 and 1A are schematic diagrams of an exemplary embodiment of the input circuit of the present invention.

FIG. 1 shows an input circuit 10 according to the present invention. An input signal voltage $V_i$ applied across input terminals 12 and 13 is coupled through resistors 13 and 14 across a winding 21 of a three-winding transformer 20. Transformer 20 also comprises windings 22 and 23. The winding sense is indicated with the conventional dot notation. The winding 22 is coupled across inverting and noninverting inputs of an op-amp 30. The noninverting input of the op-amp 30 is coupled to ground. One end of the winding 23 is coupled to the inverting input of the op-amp 30. The other end of the winding 23 is coupled through a feedback resistor 25 to the output of the op-amp 30. A capacitor 26 can optionally be coupled in parallel with the feedback resistor 25 to provide high-end frequency roll-off. Additionally, a capacitor 28 can be coupled between the inverting input and the output of the op-amp 30 to provide phase compensation, if need be, to ensure stability. The output of the op-amp 30 is coupled to an output terminal 31 at which an output voltage signal $V_o$ is generated.

For purposes of describing the operation of the present invention, the op-amp 30 is assumed to have an infinite open-loop gain. Furthermore, the op-amp inputs are assumed to be of an infinite impedance and are thus assumed to draw no current. As such, the currents through the windings 22 and 23 are assumed to be equal. As a result of the negative feedback from the output of the op-amp to its inverting input, there exists a virtual short-circuit across the op-amp inputs. In other words, the op-amp will drive its output so that the inverting input follows the noninverting input. Thus the inverting input of op-amp 30 is virtually at ground potential. This near-zero voltage condition is reflected in the windings 21 and 23. As such, none of the three windings is required to support any significant voltage. As a result, transformer coupling occurs with minimal flux density in the core. In other words, the op-amp drives a current through the windings 23 and 22 that induces in the transformer core a flux density that will cancel the flux density induced by the input signal in the winding 21. With flux density thus minimized, the tendency for the core of the transformer 20 to saturate is also minimized.

Certain performance parameters of the circuit can be calculated from the transformer characteristics and component values. For this discussion, the winding 21 will be assumed to be the reference winding. The turns ratio of the winding 22 relative to the winding 21 is denoted $n_2$ and the turns ratio of the winding 23 relative to the winding 21 is denoted $n_3$. Furthermore, each winding can be modelled as an inductance in series with a winding resistance in series with a dependant voltage source which is controlled by the currents in the other windings. The winding 21 has an inductance L and a winding resistance $r_1$. The winding 22 has an inductance expressed as $n_2^2L$ and a winding resistance $r_2$. The winding 23 has an inductance expressed as $n_3^2L$ and a winding resistance $r_3$. The resistors 13 and 14 are assumed to be equal, each with a resistance of $R_i/2$. The resistance of the feedback resistor 25 is denoted $R_f$.

From the above parameters, the transfer function for the input circuit 10 can be expressed as follows:

$$\frac{V_o}{V_i} = \frac{n_2R_f + n_2r_3 - n_3r_2}{n_2(n_2+n_3)(R_i+r_1)+r_2}\left[\frac{1}{1 - j\dfrac{(R_i+r_1)r_2}{\omega L[n_2(n_2+n_3)(R_i+r_1)+r_2]}}\right] \quad (1)$$

It follows from equation (1), that if the following condition is imposed:

$$\frac{n_2(n_2+n_3)}{r_2} >> \frac{1}{R_i+r_1} \quad (2)$$

the low-end 3 dB corner frequency, $f_{3dB(LOW)}$, can be expressed as:

$$f_{3dB(LOW)} \approx \frac{r_2}{2\pi L n_2(n_2+n_3)} \quad (3)$$

Note that $R_i$ and $R_f$ are not involved in setting the low-end 3 dB frequency.

It follows from equation (1) and condition (2) that the mid-band gain, $A_{mid}$, can be expressed as:

$$A_{mid} \approx \frac{1}{n_2+n_3}\ \frac{R_f}{R_i+r_1} \quad (4)$$

Note that the mid-band gain can be set using $R_i$ and $R_f$ without affecting the low-end 3 dB corner frequency.

Moreover, it follows from equation (1) and condition (2) that the input impedance, $Z_i$, can be expressed as:

$$Z_i \approx r_1 + R_i \quad (5)$$

Note that the input impedance is approximately purely resistive; i.e., it is approximately the sum of the winding resistance of the transformer 20 and any other external resistance that may be inserted in series.

Figure 1A:
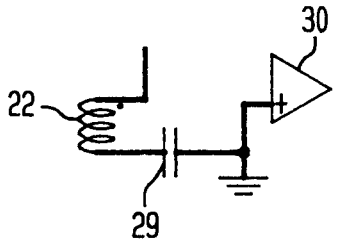

FIG. 1A shows another embodiment of the input circuit 10 in which the winding 22 is coupled to ground through a capacitor 29. Such a capacitor is used to guarantee the DC stability of the op-amp 30. Because real op-amps do not have perfectly balanced inputs, i.e., the output voltage will not be zero when the input voltages are equal, an input offset DC voltage must be applied across the op-amp inputs to guarantee that the op-amp will operate properly. If the winding resistance of the winding 22 is too small, such a voltage will not be developed across the op-amp inputs; i.e., the winding 22 would essentially be acting as a short circuit for DC voltages. Inserting the capacitor 29, which at DC locks like an open circuit, allows the input offset DC voltage to be developed, by feedback, on the inverting input of the op-amp 30.

The capacitor 29, however, will affect the frequency response of the input circuit 10. A value for this capacitor can be selected, however, which will give a maximally flat frequency response with an even lower 3 dB corner frequency.

The value for the capacitor 29 that will yield a maximally flat response can be expressed as follows:

$$C_{29} = \frac{2n_2(n_2+n_3)L}{r_2^2} \quad (6)$$

Using this value for the capacitor 29 yields a new, low-end 3 dB frequency:

$$f_{3dB(LOWw/C)} \approx \frac{r_2}{2\pi L n_2(n_2+n_3)\sqrt{2}} \quad (7)$$

Note that this frequency is approximately 30% lower than the corner frequency without the capacitor 29.

Figure 2:
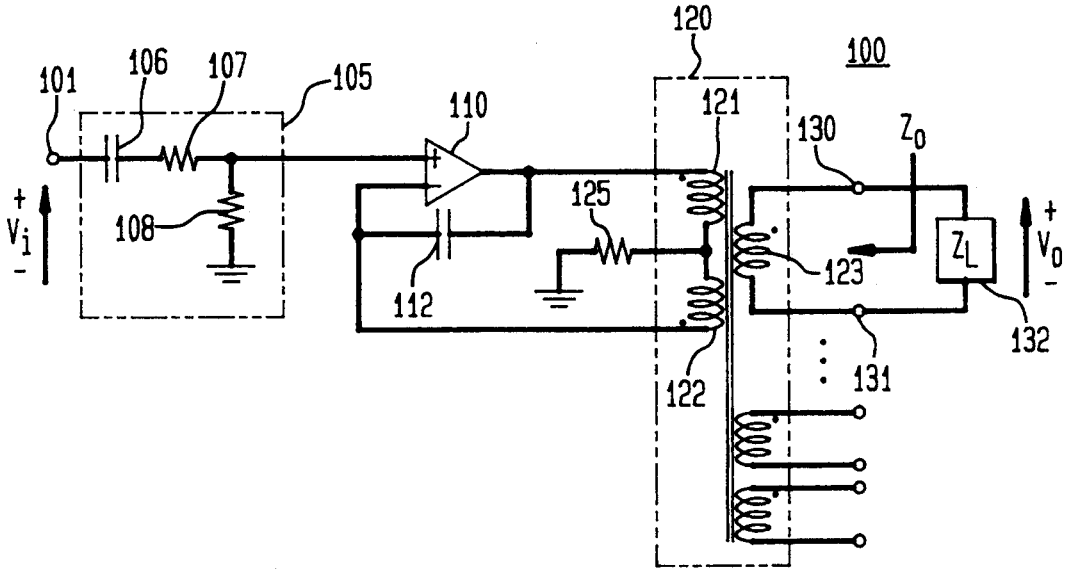
FIG. 2 is a schematic diagram of an exemplary embodiment of the output circuit of the present invention.

FIG. 2 shows an output circuit 100 according to the present invention. An input signal voltage $V_i$ applied to an input terminal 101 is first passed through an optional high-pass network 105 comprised of a capacitor 106 and resistors 107 and 108. The high-pass network 105 is used to provide DC-blocking and low-end frequency roll-off. As will be shown below, without the high-pass network 105, the low-end 3 dB frequency of the output circuit 100 is theoretically near zero.

The output of the high-pass network 105 is coupled to the noninverting input of an op-amp 110. The output of the op-amp 110 is coupled to one end of a winding 121 of a three-winding transformer 120. The transformer 120 further comprises windings 122 and 123. Note the winding directions as denoted by the dot convention. The second end of winding 121 is coupled to one end of the winding 122. This point is coupled through a resistor 125 to ground. The resistor 125 is inserted for DC stability. The other end of the winding 122 is coupled to the inverting input of the op-amp 110. A capacitor 112 can be coupled between the output of the op-amp and the inverting input to provide phase compensation, if need be, to ensure stability. The winding 123 is coupled across output terminals 130 and 131 across which an output signal voltage $V_o$ is developed and applied to a load impedance 132.

As with the input circuit, the op-amp 110 is assumed to have an infinite open-loop gain and inputs of infinite impedance. In this circuit, feedback from the op-amp output to the inverting input is provided through transformer coupling between windings 121 and 122; i.e., the voltage induced in the winding 121 by the op-amp is transformer-coupled to the winding 122. Noted however, that because of the high impedance of the inverting input of the op-amp, there is virtually no current flow through the winding 122.

By operation of the negative feedback, the voltage at the inverting input of the op-amp 110 is forced to faithfully mirror the voltage applied to the noninverting input. In other words, through negative feedback, the op-amp 110 will drive the winding 121 to induce in the winding 122 a voltage that follows the noninverting input of the op-amp.

The voltage across any transformer winding can be attributed to three components: 1) current flow through the winding resistance, 2) current flow through the winding inductance, and 3) voltage induced by current flowing in other windings, i.e., voltage due to transformer coupling. Because there is no significant current flow in winding 122, there is no significant component of voltage across winding 122 attributable to its resistance and inductance. As a result, the voltage across the winding 122 is due entirely to transformer coupling from the winding 121, which is driven by the op-amp 110. Because negative feedback forces the voltage across the winding 122 to follow the voltage applied to the noninverting input, the op-amp output voltage driving the winding 121 will thus be forced to induce in the winding 122 a faithful representation of the voltage applied to the noninverting input. By symmetry, the same faithful representation of the input voltage induced in the winding 122 will also be induced in the winding 123 and delivered to the load 132.

Note that, unlike the winding 122, the winding 121 carries significant current. As such, the voltage across the winding 121 includes components attributable to its resistance and inductance. Therefore the voltage signal at the output of the op-amp 110 will not be the same as the clean voltage signal that is coupled from the winding 121 across to the other windings. Nonetheless, the op-amp output voltage will be forced, by virtue of negative feedback, to assume whatever voltage is necessary to induce in the windings 122 and 123 a voltage that cleanly mirrors the noninverting input voltage.

As in the case of the input circuit 10, provision for DC stability is made in the output circuit 100. In the embodiment of the output circuit shown in FIG. 2, resistor 125 is provided for this purpose. The value of this resistor is relatively small compared to the impedance of the windings and would be zero for an ideal op-amp. DC feedback from the output of the op-amp to the inverting input is needed to provide an input offset DC voltage. Such a voltage is developed across the resistor 125. The resistor 125, however, affects the frequency response and the output impedance of the output circuit 100.

As with the input circuit, certain performance parameters of the output circuit can be calculated from the transformer characteristics and component values. For this discussion, the winding 121 will be assumed to be the reference winding. The turns ratio of the winding 122 relative to the winding 121 is denoted $n_2$ and the turns ratio of the winding 123 relative to the winding 121 is denoted $n_3$. The winding 121 has an inductance L and a winding resistance $r_1$. The winding 122 has an inductance expressed as $n_2^2L$ and a winding resistance $r_2$. The winding 123 has an inductance expressed as $n_3^2L$ and a winding resistance $r_3$. The resistance of the resistor 125 is denoted $R_{DC}$. The complex impedance of the load 132 is denoted $Z_L$.

Assuming that the high-pass network 105 is not present, i.e., the input signal voltage $V_i$ is applied directly to the noninverting input of op-amp 110, and assuming further that $R_{DC}$, the value of the resistor 125, is negligible relative to the impedance of the windings, the transfer function for the output circuit 100 can be expressed as follows:

$$\frac{V_o}{V_i} \approx \frac{n_3}{n_2} \frac{Z_L}{Z_L + r_3 + \frac{n_3^2}{n_2} R_{DC}} \tag{8}$$

It follows from this expression that if the load 132 is capacitive and/or resistive (i.e., $Z_L = R_L + 1/jWC_L$), there will theoretically be no low-end frequency roll-off. Unless the load 132 is inductive (i.e., $Z_L = jwL_L$), the low-end frequency response of the output circuit 100 is limited primarily by characteristics of the op-amp 110 and second-order characteristics of the transformer not accounted for in the transformer model assumed, such as inter-winding capacitance and leakage inductance.

If $R_{DC}$, the value of resistor 125, is not negligible relative to the impedance of the transformer, the low-end 3 dB frequency can be expressed as:

$$f_{3dB(LOW)} \approx \frac{R_{DC}}{2\pi L n_2} \tag{9}$$

For a typical transformer 120 (i.e., L=125 mH) and a typical value for resistor 125 (i.e., 10 ohms), the calculated low-end 3 dB corner frequency is still quite low; i.e., on the order of 10 Hz. If a higher low-end 3 dB frequency is desired, the high-pass network 105 can be used to adjust the low-end 3 dB frequency to the desired value.

The output impedance, $Z_o$, can be expressed as:

$$Z_o \approx r_3 + \frac{n_3^2}{n_2} R_{DC} \tag{10}$$

Note that the output impedance is approximately purely resistive and is a function only of the winding resistance of the output winding 123 and the resistance of the resistor 125 as reflected into the output winding.

To illustrate the resultant improvement in performance afforded by transformer compensation in accordance with the present invention, low-end 3 dB frequency and the input and output impedances for a typical miniature audio transformer, with and without compensation, will be compared.

Figure 3:
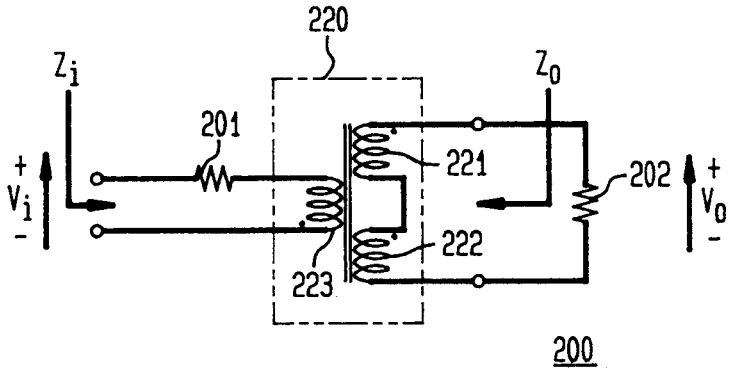
FIG. 3 (PRIOR ART)
FIG. 3 is a schematic diagram of an uncompensated transformer, as would typically be used in the prior art.

FIG. 3 shows a circuit 200 with an uncompensated transformer 220. The transformer 220 comprises three windings, 221, 222, and 223. An input voltage signal $V_i$ is applied across the winding 223 through a resistor 201. The windings 221 and 222 are coupled in series and a resistor 202 is coupled across the series combination of the two windings. An output voltage signal $V_o$ is developed across the resistor 202.

For purposes of comparison, the transformer 220 will be assumed to be a typical, commercially available miniature audio transformer. Table 1 shows the values of those characteristics of such a transformer, which are relevant to this analysis.

TABLE 1

| Winding | Turns Ratio | Resistance (ohms) | Inductance (mH) |
|---|---|---|---|
| 221 | 1 | 53 | 125 |
| 222 | 1 | 45 | 125 |
| 223 | 2 | 75 | 500 |

It can be shown that the low-end 3 dB frequency and the input and output impedances of the circuit 200 will depend, in large part, on the values of components external to the transformer 220, in this case resistors 201 and 202. If the value of resistor 201 is 600 ohms and the value of resistor 202 is 620 ohms, the low-end 3 dB frequency for the circuit 200 with the transformer 220 as described, is calculated to be 110 Hz. The input impedance will vary between 75 ohms, at DC, and 793 ohms, at very high frequencies. The output impedance will vary between 98 ohms, at DC, and 773 ohms, at very high frequencies. The input and output impedances are both dependant on frequency and external component values.

If the transformer 220 is to be compensated using the input circuit 10 of FIG. 1, it would be represented as transformer 20 with the winding 21 corresponding to the winding 221, the winding 22 corresponding to the winding 222, and the winding 23 corresponding to the winding 223. Applying the values of Table 1 to equations (3) and (6), the low-end 3 dB frequency is calculated to be only 19.1 Hz and the input impedance is substantially constant at 653 ohms.

The transformer 220 can also be compensated using the output circuit 100 of FIG. 2. The improvement in the low-end 3 dB frequency is immediately apparent since it is near zero for the output circuit 100, under the transformer model assumed. Moreover, unlike the output impedance of the circuit 200, the output impedance of the circuit 100 is substantially constant over frequency and external component values.

It should be apparent that several variations of the above embodiments are possible. For instance, in the input circuit of FIG. 1, the input winding 21 can be replaced with multiple input windings, each driven by an individually isolated input signal. A summation of the several input signals would be effectuated. Similarly, in the output circuit of FIG. 2, the output winding 123 can be replaced with multiple output windings, each driving an individually isolated load.

What is claimed is:

1. A system for linearizing transformer operation, comprising:

a transformer having a plurality of windings;

an active device having an input and an output coupled to each other through a feedback path comprising said transformer;

and transformer coupling established between said windings with substantially no current through at least one of the windings.

2. The system of claim 1, wherein the transformer further comprises a first winding of the transformer coupled to the output of the active device;

a second winding of the transformer coupled to the input of the active device; and a third winding for driving a load.

3. The system of claim 2, wherein current through the second winding is substantially zero.

4. The system of claim 2, wherein the active device has a high open-loop gain.

5. The system of claim 2, wherein the transformer comprises a plurality of windings for driving a plurality of loads.

6. The system of claim 2, wherein the active device comprises an inverting input coupled to said second winding and a noninverting input for receiving an input signal.

7. The system of claim 6, wherein a high-pass network is coupled to said noninverting input of the active device.

8. The system of claim 7, further comprising a system output with an output impedance substantially equal to a resistance.

9. A system for transformer coupling a plurality of input signals, the system comprising:

a plurality of system inputs for receiving the plurality of input signals;

an active device having an input and an output coupled through a feedback path; and a transformer having a plurality of windings coupled to the plurality of system inputs for transformer coupling the plurality of input signals, a second winding coupled to the input of the active device, and a third winding;

the feedback path including the third winding of the transformer.

10. A system for transformer coupling an input signal, the system comprising:

a transformer having first, second, and third windings, the third winding being coupled to a system output for driving a load; and an active device having a first input for receiving the input signal and a second input and an output coupled through a feedback path comprising the transformer, with the output of the active device being coupled to a first winding of the transformer and the second input of the active device being coupled to a second winding of the transformer, wherein current through the second winding is substantially zero.

* * * * *